US007380770B2

(12) United States Patent
Tzeng

(10) Patent No.: US 7,380,770 B2
(45) Date of Patent: Jun. 3, 2008

(54) HOIST DEVICE HAVING SELECTIVE POWER SOURCE

(75) Inventor: Yeong-Guang Tzeng, Taipei (TW)

(73) Assignee: Tefua Mfg. Co., Ltd., Taipei (TW)

( * ) Notice: Subject to any disclaimer, the term of this patent is extended or adjusted under 35 U.S.C. 154(b) by 0 days.

(21) Appl. No.: 11/743,161

(22) Filed: May 2, 2007

(65) Prior Publication Data

US 2008/0083911 A1 Apr. 10, 2008

(30) Foreign Application Priority Data

May 10, 2006 (TW) ..... 95207962 U

(51) Int. Cl.
*B66D 1/30* (2006.01)

(52) U.S. Cl. ..... 254/372; 254/358; 254/366; 254/368

(58) Field of Classification Search ..... 254/372, 254/358, 376, 378, 366, 368
See application file for complete search history.

(56) References Cited

U.S. PATENT DOCUMENTS 4,664,357 A * 5/1987 Nishimura ..... 254/351
5,271,607 A * 12/1993 Kubota et al. ..... 254/342
5,535,988 A * 7/1996 Nishimura ..... 254/352
5,556,078 A * 9/1996 Kubota et al. ..... 254/368
5,641,151 A * 6/1997 Kataoka ..... 254/352
6,450,482 B1 * 9/2002 Struck ..... 254/358
6,554,255 B2 * 4/2003 Fujikawa ..... 254/358
6,578,824 B2 * 6/2003 Samejima ..... 254/366

* cited by examiner

*Primary Examiner*—Emmanual M Marcelo
(74) *Attorney, Agent, or Firm*—Leong C. Lei

(57) ABSTRACT

The hoist device mainly contains a gear assembly and a ratchet braking assembly. The gear assembly mainly contains a chain wheel driven by a main axle running through the ratchet braking assembly which mainly contains a ratchet wheel sandwiched between a pair of brake rings. The ratchet wheel, controlled by stopping blocks, can only turn in one direction. At an end of the main axle, there is a hexagonal cylindrical sleeve so that either an ordinary wrench or a power tool can be used to turn the main axle. As the main axle is turned to lift an object, the ratchet wheel clamped by the brake rings is turned as well. When the main axle is turned to the other direction, the brake rings release the ratchet wheel so that it will not prevent the chain wheel to lower the object.

1 Claim, 7 Drawing Sheets

HOIST DEVICE HAVING SELECTIVE POWER SOURCE

TECHNICAL FIELD OF THE INVENTION

The present invention generally relates to hoist devices, and more particularly to a hoist device can be selectively driven by manual labor or a power tool.

DESCRIPTION OF THE PRIOR ART

Hoists are commonly used to lift heavy objects. Conventional hoists can be categorized as manual ones or electrical ones. Manual hoists are space-efficient, inexpensive, and can be widely applied in various scenarios. However, for heavier objects, multiple manual hoists are required and the manual operation of these hoists demands significant labor. In contrast, electrical hoists are more capable of lifting objects of significant weight. Their operation is also more convenient and less laborious. These advantages are however shadowed by the hefty price tag and the limitation on the applicable operation environment.

SUMMARY OF THE INVENTION

A novel hoist device is provided herein which strikes a balance between manual and powered operations by allowing the hoist device to be driven by an ordinary standard wrench or a power tool selectively.

The hoist device mainly contains a gear assembly and a ratchet braking assembly. The gear assembly mainly contains a chain wheel driven by a main axle through a set of gears. The main axle runs through the ratchet braking assembly which mainly contains a ratchet wheel sandwiched between a pair of brake rings. The ratchet wheel, controlled by stopping blocks, can only turn in one direction. At an end of the main axle, there is a hexagonal cylindrical sleeve with an axial rectangular socket so that either an ordinary wrench or a power tool can be used to turn the main axle.

As main axle and thereby the chain wheel turn to lift an object, the ratchet wheel clamped by the brake rings is turned as well. When the object is lifted to an appropriate height and the driving of the main axle stops, the ratchet braking assembly holds the object at its place. When the main axle is turned to the other direction, the brake rings release the ratchet wheel so that it will not prevent the chain wheel to lower the object.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
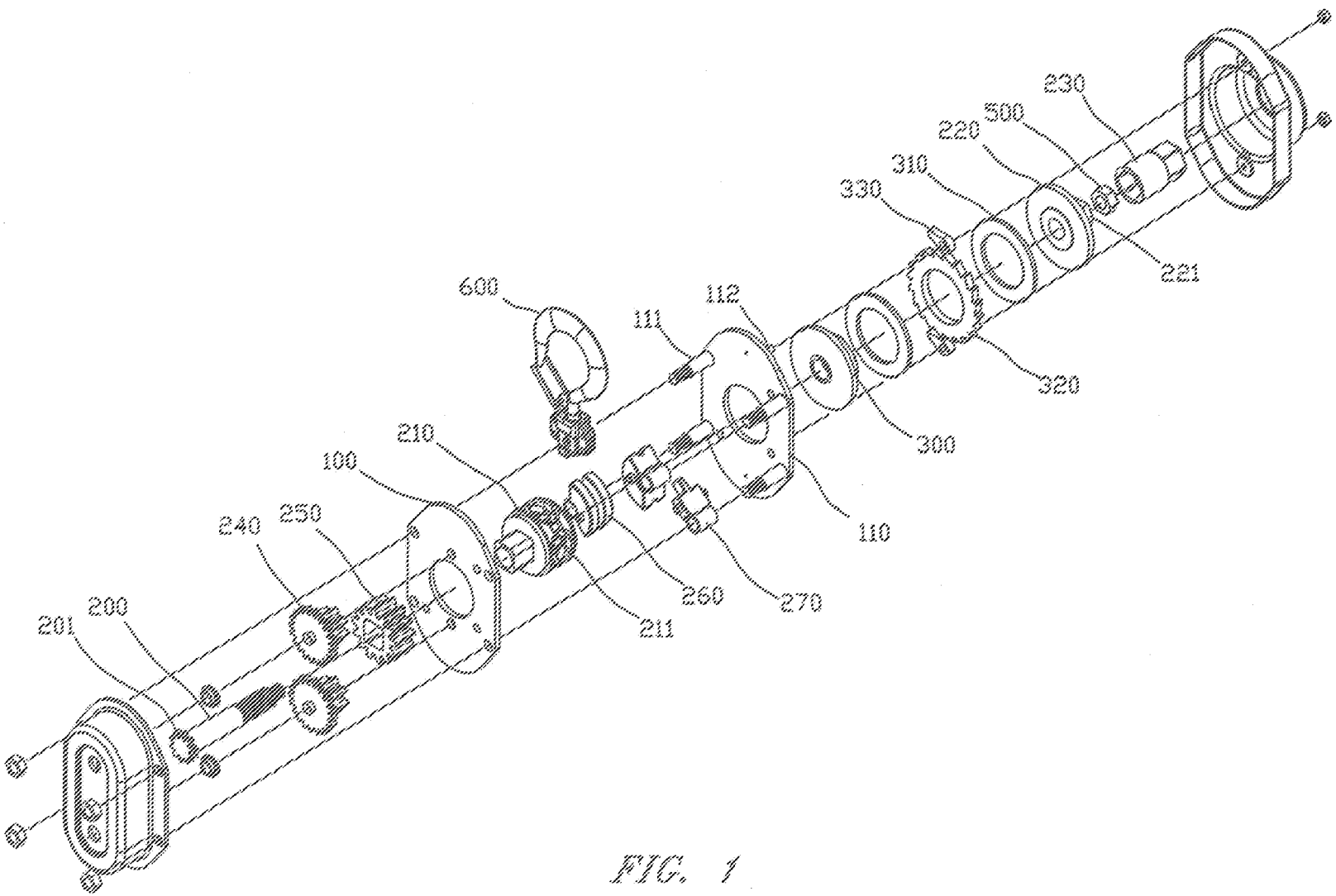
FIG. 1 is a perspective diagram showing the various components of a hoist device according to an embodiment of the present invention.
Figure 2:
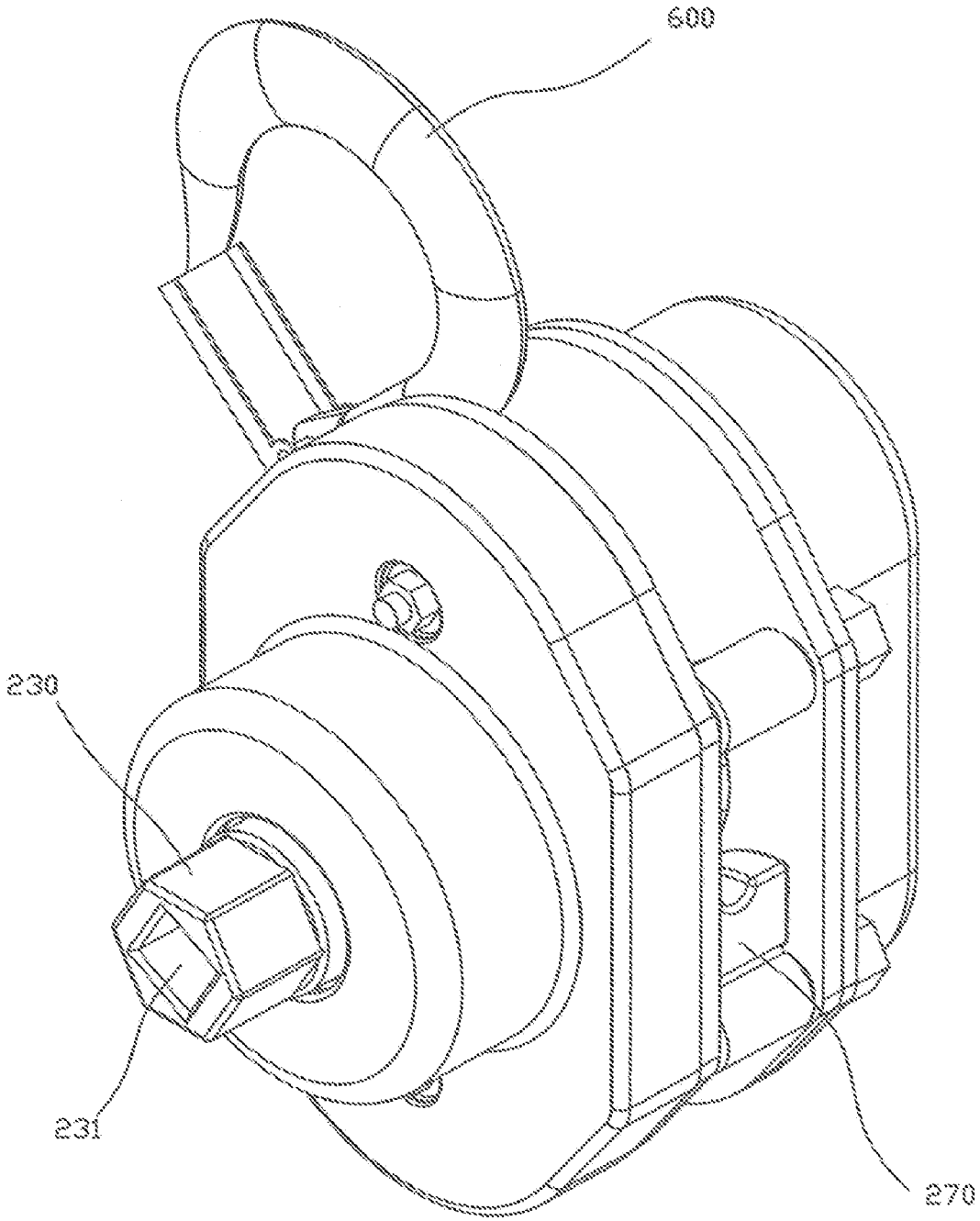
FIG. 2 is a perspective diagram showing the hoist device of FIG. 1 after it is assembled.
Figure 3:
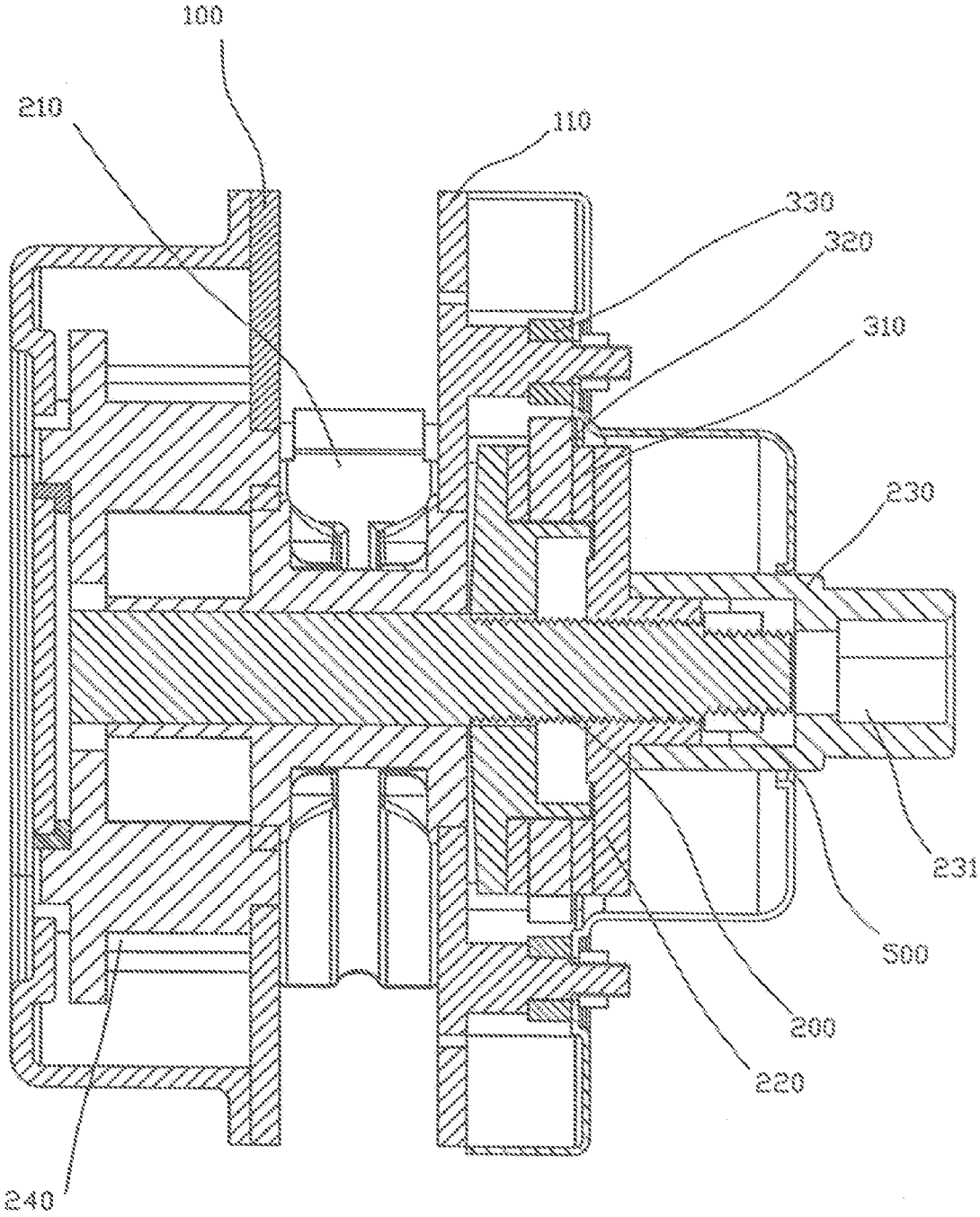
FIG. 3 is a sectional diagram showing the hoist device of FIG. 1 after it is assembled.
Figure 4:
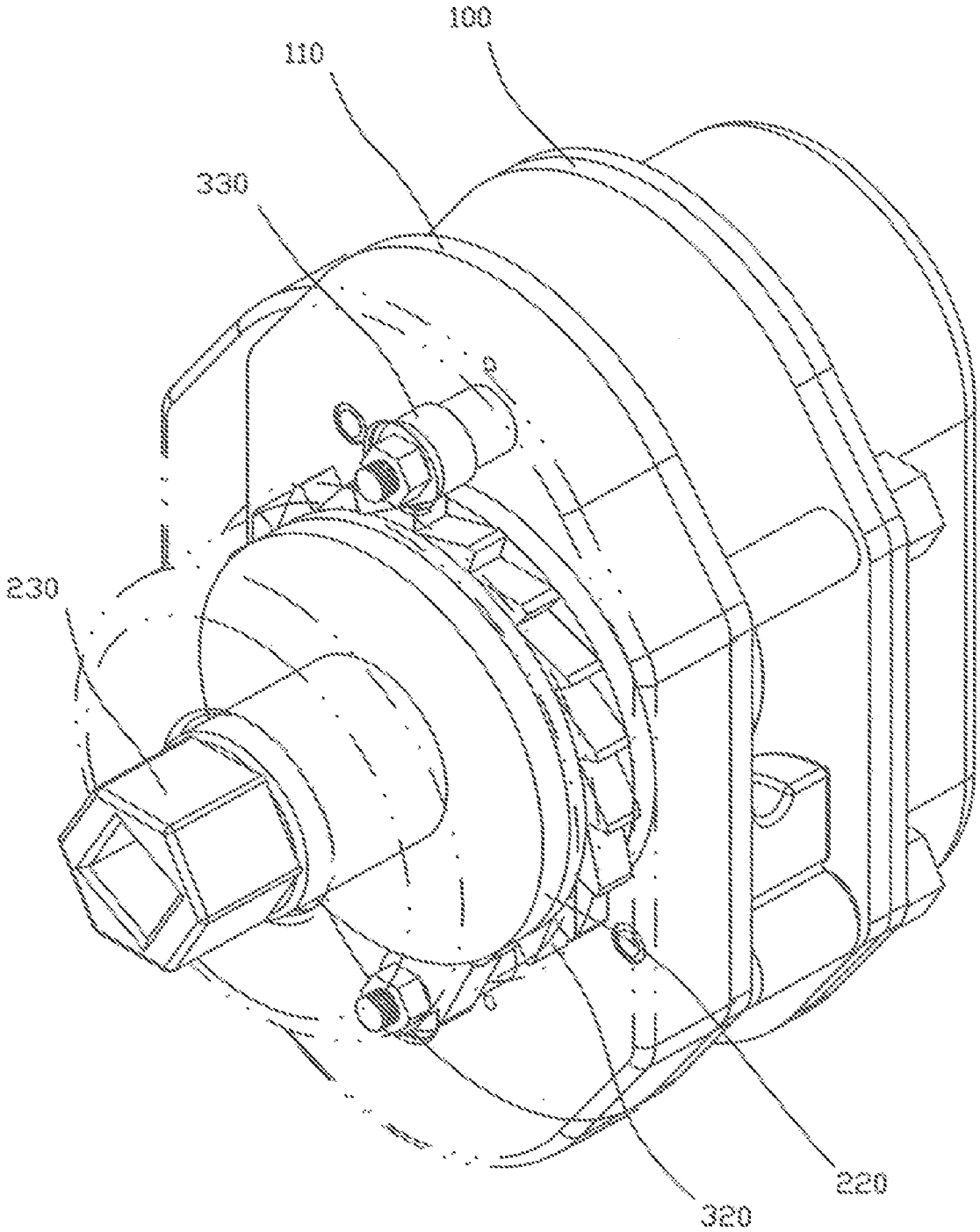
FIG. 4 is a schematic perspective diagram showing the ratchet braking assembly of the hoist device of FIG. 1.
Figure 5:
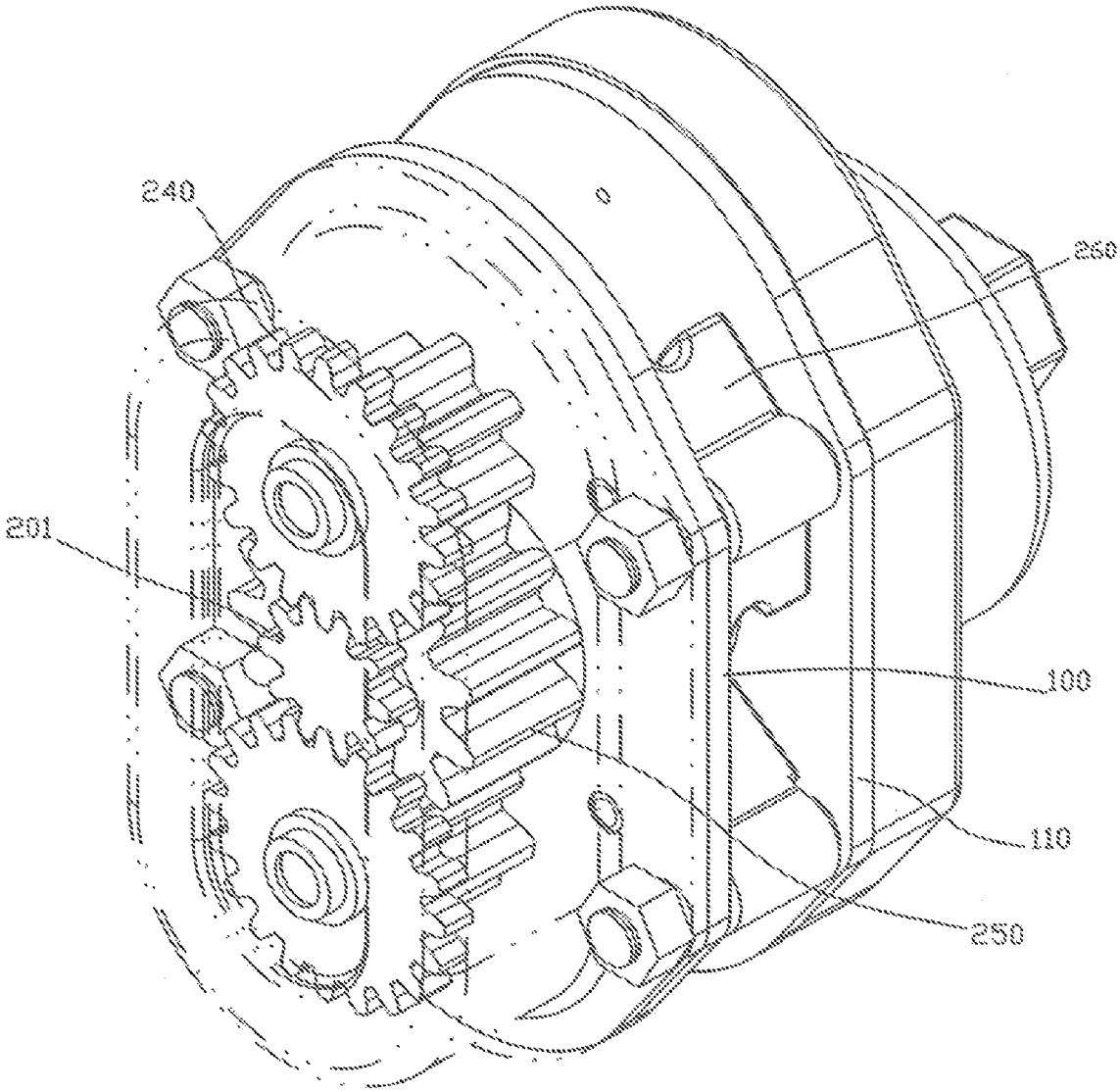
FIG. 5 is a schematic perspective diagram showing the gear assembly of the hoist device of FIG. 1.
Figure 6:
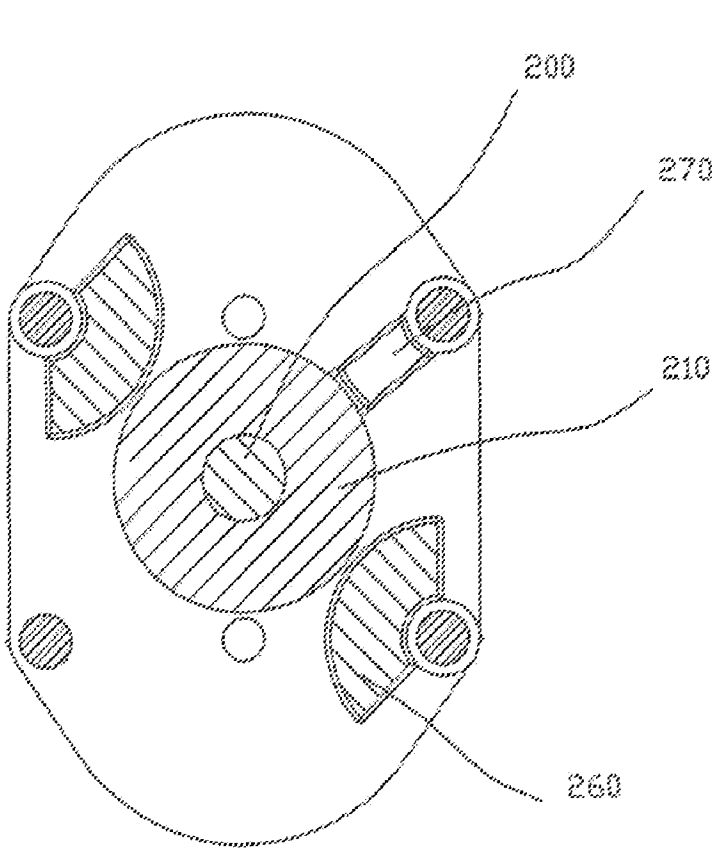
FIG. 6 is a cross-sectional diagram showing the hoist device of FIG. 1.
Figure 6:
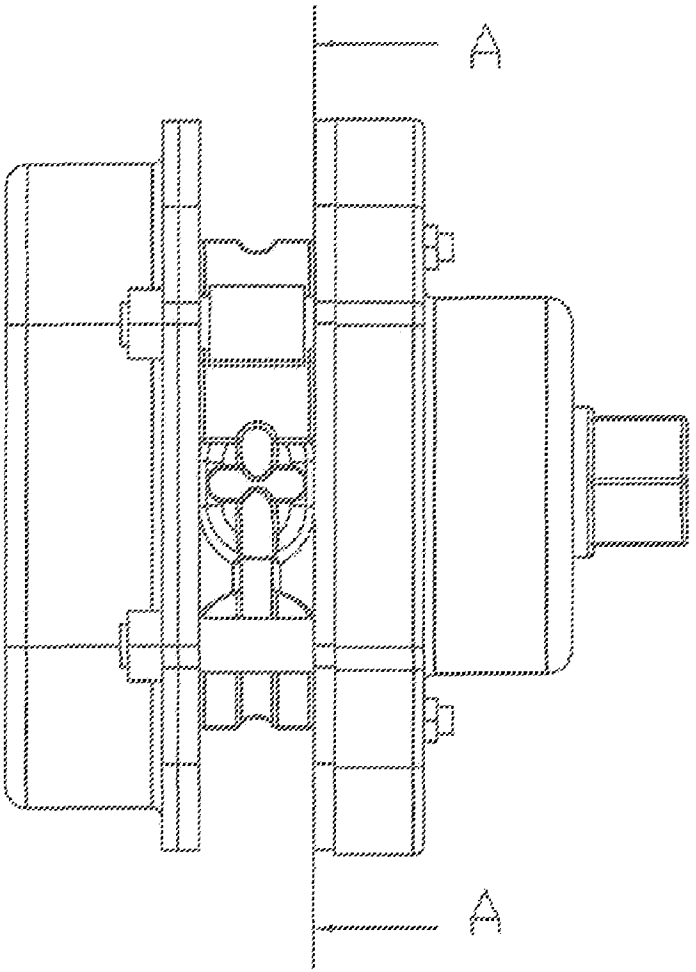
Figure 7:
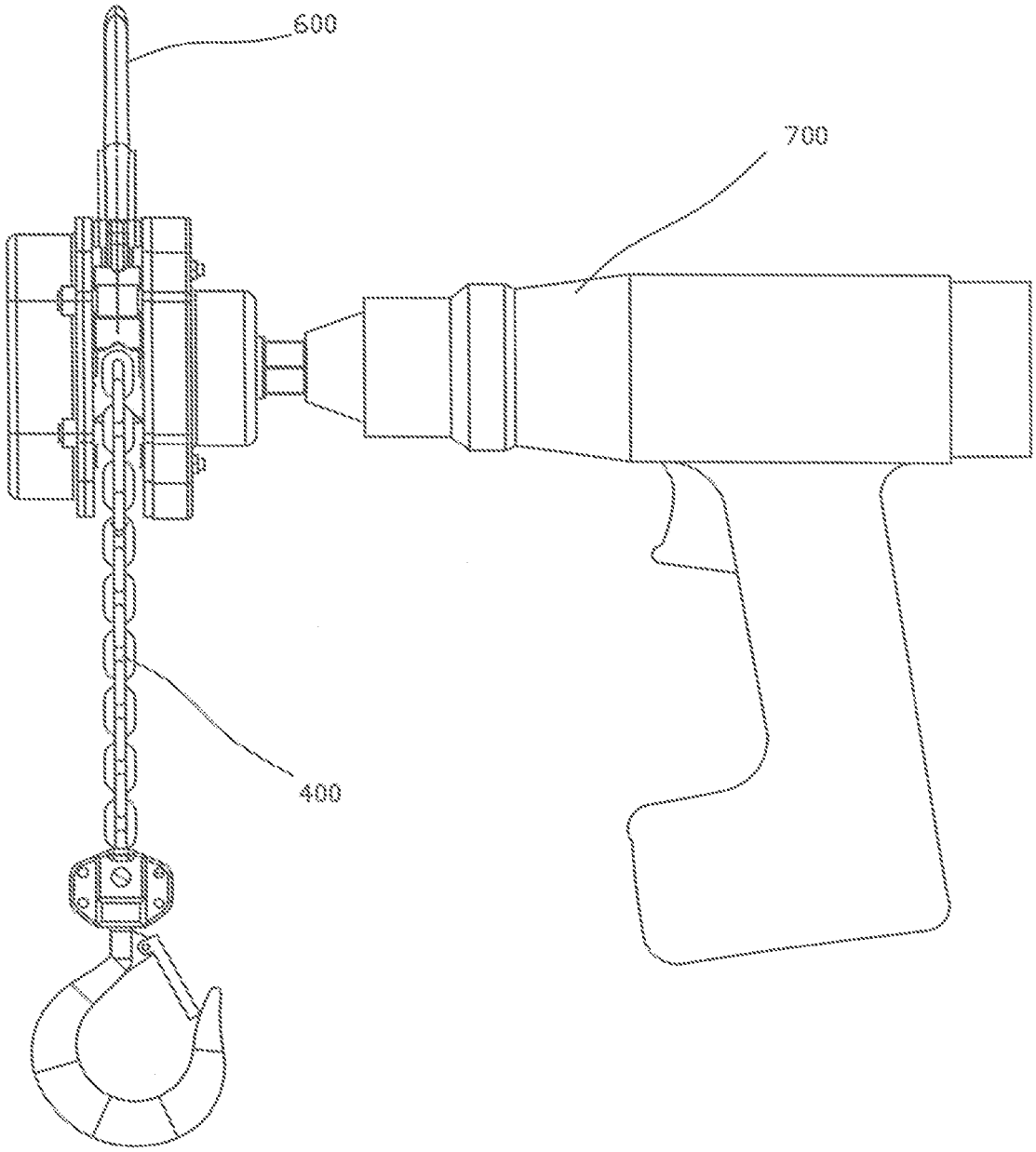
FIG. 7 is a schematic diagram showing an application scenario of the host device of FIG. 1 driven by a power tool.

As shown in FIGS. 1 to 7, a hoist device according to an embodiment of the present invention mainly contains a gear assembly and a ratchet braking assembly.

The gear assembly mainly contains a chain wheel 210 sandwiched between a first plate 100 and a second plate 110. The second plate 110 has a number of parallel supporting rods 111 around the chain wheel 210 running perpendicularly through the first plate 100. Around the circumference of the chain wheel 210, a number of indentations 211 conforming to the shape of a chain 400's links are provided. Therefore, when the chain wheel 210 turns, the chain 400 surrounding the chain wheel 210 is pulled accordingly. A first supporting rod 111 runs through a shackle 600 also sandwiched between the first and second plates 100 and 110 for hanging the hoist device. To properly align and drive the chain 400, two fan-shaped chain guiding blocks 260 are provided on two opposing second and third supporting rods 111, respectively, together with an elongated chain stopping block 270 provided on a fourth supporting rod 111, all interfacing with the chain wheel 210 at the circumference. The chain guiding and stopping blocks 260 and 270 are also located between the first and second plates 100 and 110.

The chain wheel 210 has a tubular end (not numbered) that penetrates through the first plate 100 into the center of a main gear 250 located outside the first plate 100. The main gear 250 is engaged by a pair of passive gears 240, which in turn are engaged by a driving gear 201 at a first end of a main axle 200. The main axle 200 rotatably runs through the main gear 250 and the chain wheel 210, and extends outside the second plate 110 for an appropriate distance.

The ratchet braking assembly is at the outside of the second plate 110. Starting from the second plate 100 outward, there are a base disc 300, a first brake ring 310, a ratchet wheel 320, a second brake ring 310, and a cap disc 220. Two opposing stopping blocks 330 engage the teeth of the ratchet wheel 320 so that the ratchet wheel can only turn in one direction. Together with the friction of the brake rings 310, the ratchet braking assembly prevents a lifted object from falling or slipping. The stopping blocks 330 are mounted on two sticks 112 extended perpendicularly from the outside of the second plate 110, respectively.

The main axle 200 penetrates through the foregoing ratchet braking assembly and, at a second end of the main axle 200, there are threads and grooves (not numbered) for interfacing with the cap disc 220 and for fastening to a nut 500. A hexagonal cylinder 221 is provided on the outside of the cap disc 220, which plugs into a first end of a hexagonal cylindrical sleeve 230. A second end of the sleeve 230 also provides an axial rectangular socket 231. An ordinary hexagonal wrench or a power tool 700 (using air or electricity) having an appropriate plug can be used to drive the sleeve 230 and, thereby, the main axle 200 to turn. As described above, the chain wheel 210 will be turned as well so as to pull the chain 400. In the man time, as the main axle 200 turns, the cap disc 220 closes in to press the ratchet wheel 320 and the brake rings 310 against the base disc 300. The friction therebetween will cause the ratchet wheel 320 to turn as well. When the driving to the main axle 200 stops, the friction exerted by the brake rings 310 and the effect of the stopping blocks 330 hold the lifted object at its place. To lower the object, by using the wrench or power tool to turn the main axle 200 in the opposite direction, the cap disc 220 is moved away from the ratchet wheel 320 and the brake rings 310. As such, the friction and the stopping blocks 330 of the ratchet wheel 320 will not prevent the chain wheel 210 to turn in the opposite direction to lower the object.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A hoist device comprises:

a gear assembly which includes a chain wheel sandwiched between a first plate and a second plate, said second plate having a number of parallel supporting rods around said chain wheel running perpendicularly through said first plate, a number of indentations conforming to shape of a chain are provided around a circumference of said chain wheel thereby pulling said chain surrounding said chain wheel when said chain wheel turns, a first one of said supporting rods running through a shackle sandwiched between said first and second plates for hanging said hoist device, two fan-shaped chain guiding blocks are provided for aligning and driving said chain on two opposing second and third ones of said supporting rods, respectively, together with an elongated chain stopping block provided on a fourth one of said supporting rods, all interfacing with said chain wheel at a circumference, said chain guiding and stopping blocks being located between said first and second plates, said chain wheel having a tubular end that penetrates through said first plate into a center of a main gear located outside said first plate, said main gear being engaged by a pair of passive gears which in turn are engaged by a driving gear at a first end of a main axle, said main axle rotatably running through said main gear and said chain wheel, and extends outside said second plate for a distance; and a ratchet braking assembly located outside of said second plate and including a base disc, a first brake ring, a ratchet wheel, a second brake ring, and a cap disc starting from said second plate outward, two opposing stopping blocks engaging teeth of said ratchet wheel thereby limiting said ratchet wheel to turn in one direction only, said ratchet braking assembly preventing a lifted object from falling or slipping with friction of said brake rings, said stopping blocks being mounted on two sticks extended perpendicularly from outside of said second plate respectively;

said main axle penetrating through said ratchet braking assembly and having a second end provided with threads and grooves for interfacing with said cap disc and for fastening to a nut, and a hexagonal cylinder provided on an outside of said cap disc and plugging into a first end of a hexagonal cylindrical sleeve, a second end of said sleeve providing an axial rectangular socket;

whereby when a hexagonal wrench or a power tool is used to drive said sleeve to turn said main axle, said chain wheel will be turned as well so as to pull said chain, and said cap disc closes in to press said ratchet wheel and said brake rings against said base disc, and friction therebetween will cause said ratchet wheel to turn as well; when driving to said main axle stops, friction exerted by said brake rings and effect of said stopping blocks will hold lifted object in place; when desired to lower said object, a wrench or power tool is used to turn said main axle in an opposite direction, said cap disc is moved away from said ratchet wheel and said brake rings.

* * * * *